US009250025B2

(12) United States Patent
Lee

(10) Patent No.: US 9,250,025 B2
(45) Date of Patent: Feb. 2, 2016

(54) METHOD FOR HEAT TRANSFER AND DEVICE THEREFOR

(75) Inventor: Jeong Hyun Lee, Gwachun Shi (KR)

(73) Assignee: NEXCHIP TECHNOLOGIES, Doha (QA)

( * ) Notice: Subject to any disclaimer, the term of this patent is extended or adjusted under 35 U.S.C. 154(b) by 614 days.

(21) Appl. No.: 12/445,110

(22) PCT Filed: Jul. 27, 2007

(86) PCT No.: PCT/KR2007/003622

§ 371 (c)(1),
(2), (4) Date: Apr. 10, 2009

(87) PCT Pub. No.: WO2008/044823

PCT Pub. Date: Apr. 17, 2008

(65) Prior Publication Data

US 2010/0084113 A1 Apr. 8, 2010

(30) Foreign Application Priority Data

Oct. 11, 2006 (SG) ..... 200607076-7

(51) Int. Cl.
*F28D 15/04* (2006.01)
*F28D 15/02* (2006.01)

(52) U.S. Cl.
CPC ..... *F28D 15/04* (2013.01); *F28D 15/046* (2013.01); *F28D 15/0233* (2013.01); *F28D 15/0283* (2013.01); *F28F 2225/04* (2013.01)

(58) Field of Classification Search
CPC ..... F28D 15/04; F28D 15/046
USPC ..... 165/104.26, 104.33
See application file for complete search history.

(56) References Cited

U.S. PATENT DOCUMENTS 5,761,037 A 6/1998 Anderson et al.
5,950,710 A 9/1999 Liu
(Continued)

FOREIGN PATENT DOCUMENTS

CN 2704925 6/2005
DE 19950402 A1 5/2000
(Continued)

OTHER PUBLICATIONS

Lee, CN Application Serial No. 200780040269.0, Office Action from the State Intellectual Property Office of P.R.C. dated Mar. 31, 2010, 6 pages.
(Continued)

*Primary Examiner* — Marc Norman
*Assistant Examiner* — Devon Russell
(74) *Attorney, Agent, or Firm* — Richard C. Litman

(57) ABSTRACT

A heat transfer device comprising at least an aggregate of fibers or sheet of fibres (60) with internal passages and holes capable of capillary transport of liquids capable of capillary convection of coolant fluid from a heat source region (54) to heat dissipation region (56) and vice versa. A supply of coolant fluid in sufficient amount is provided to be absorbed or contained by said fibers or sheet of fibers (60) with internal passages and holes capable of capillary transport of liquids. A pressure tension member (70) comprising a strong yet resilient structure placed within said confined space and exerting pressure on said aggregate of fibers or sheet of fibers (60) with internal passages and holes capable of capillary transport of liquids against said heat source region (54) and/or heat dissipation region (57). A plurality of undulations are provided on said pressure tension member, including laterally extending ribs or protuberance (84) and protrusions (82) to accentuate the pressure exerted by the pressure tension member (70). A casing then encloses hermetically the above components.

11 Claims, 13 Drawing Sheets

(56) References Cited

U.S. PATENT DOCUMENTS

| | | | | |
|---|---|---|---|---|
| 6,293,332 | B2 * | 9/2001 | Li | 165/104.26 |
| 6,446,706 | B1 * | 9/2002 | Rosenfeld et al. | 165/46 |
| 7,261,142 | B2 * | 8/2007 | Kawahara et al. | 165/104.26 |
| 7,839,630 | B2 * | 11/2010 | Hwang et al. | 361/679.47 |
| 2002/0020518 | A1 * | 2/2002 | Li | 165/104.11 |
| 2004/0040696 | A1 | 3/2004 | Cho et al. | |
| 2005/0087327 | A1 | 4/2005 | Wang et al. | |
| 2006/0124280 | A1 | 6/2006 | Lee et al. | |
| 2006/0144565 | A1 * | 7/2006 | Tsai et al. | 165/104.26 |
| 2007/0034358 | A1 * | 2/2007 | Lee | 165/104.26 |
| 2007/0240858 | A1 * | 10/2007 | Hou et al. | 165/104.26 |
| 2007/0240860 | A1 * | 10/2007 | Meyer et al. | 165/104.26 |
| 2008/0210407 | A1 * | 9/2008 | Kim et al. | 165/104.26 |

FOREIGN PATENT DOCUMENTS

| | | | |
|---|---|---|---|
| JP | 2002062067 | A | 2/2002 |
| JP | 2002303494 | A | 10/2002 |
| KR | 1020040051219 | A | 6/2004 |
| KR | 1020060059926 | A1 | 6/2006 |
| KR | 20-0425267 | | 9/2006 |
| WO | 99/42781 | A1 | 8/1999 |
| WO | 2006/073269 | A1 | 7/2006 |
| WO | WO 2006073269 | A1 * | 7/2006 |

OTHER PUBLICATIONS

Yun Gi Woong, PCT Written Opinion of the International Searching Authority, Korean Intellectual Property Office, Nov. 14, 2007.

Martinez Rico, Supplemental European Search Report, European Patent Office, Jul. 13, 2013.

Patent Cooperation Treaty, International Search Report for PCT/SG2007/000345 (WO2008/045004) dated Jan. 21, 2008, 3 pages.

* cited by examiner

<Prior Art>

<Prior Art>

<Prior Art>

<Prior Art>

<Prior Art>

<Prior Art>

Figure 5
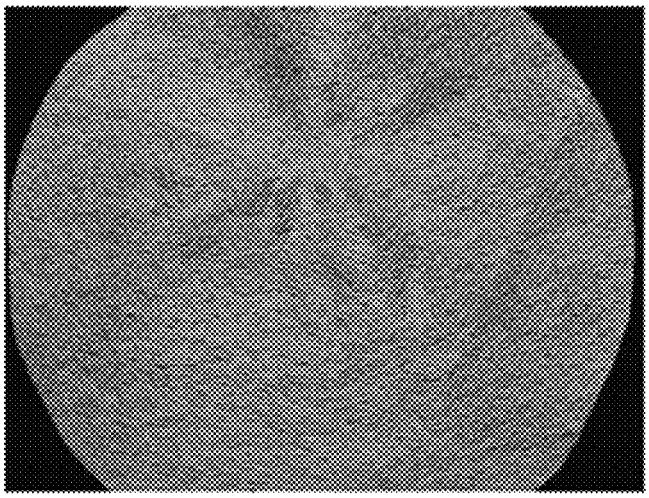
Fig 5a
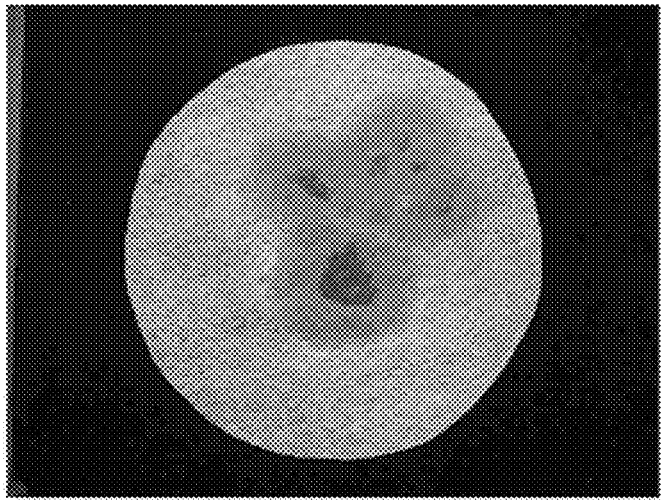
Fig 5b

Figure 7
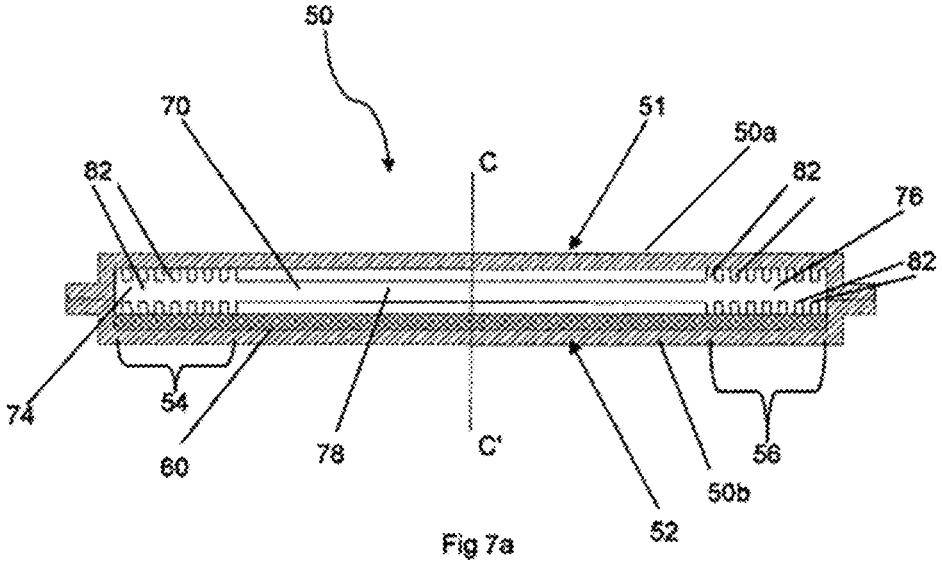
Fig 7a
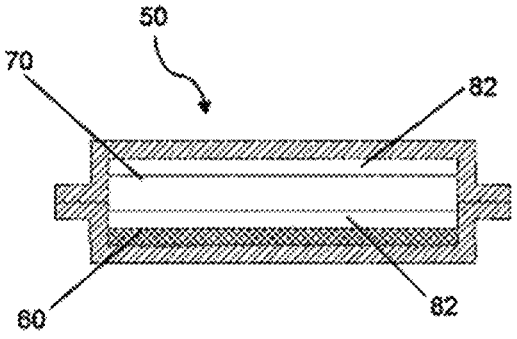
Cross section C-C'
Fig 7b

Figure 9
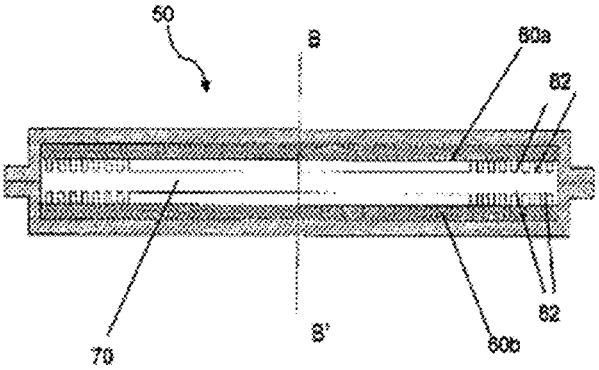
Fig 9a
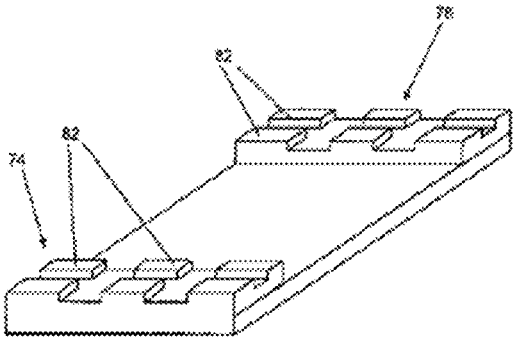
Fig 9c
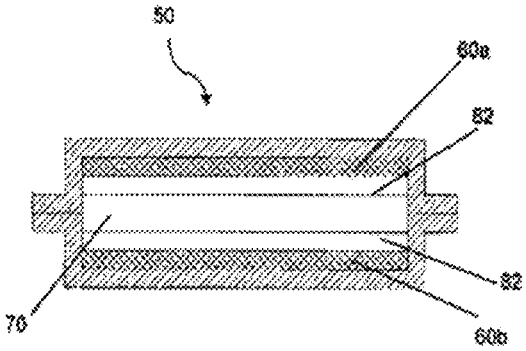
Cross section B-B'
Fig 9b
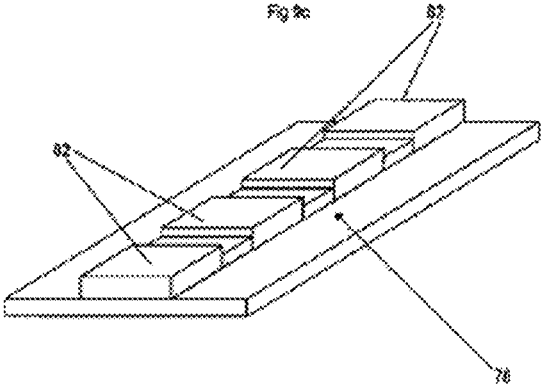
Fig 9d Figure 13
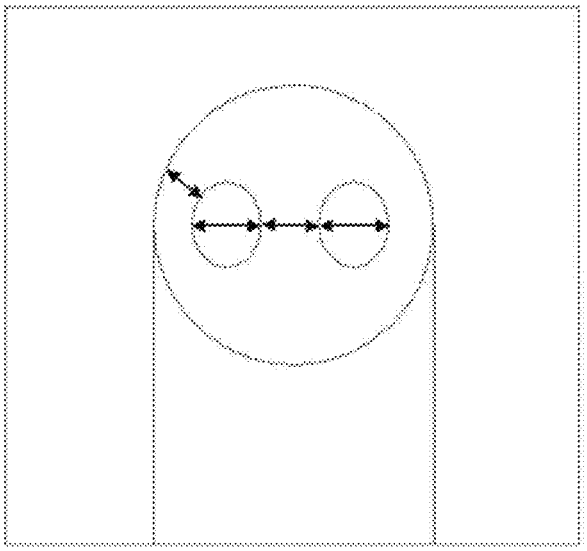
Fig 13a
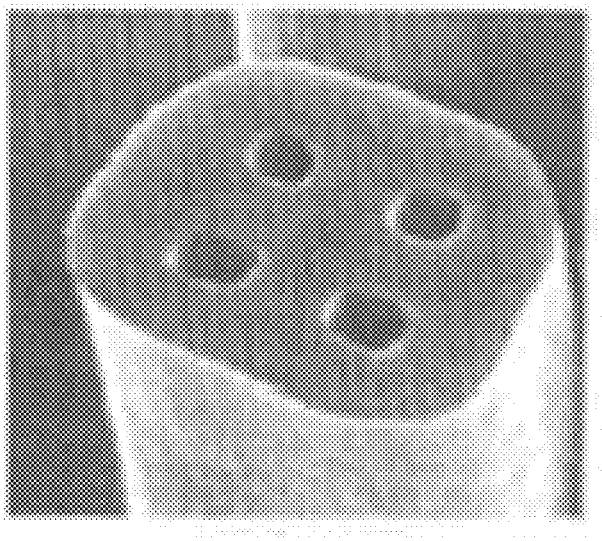
Fig 13b Figure 14
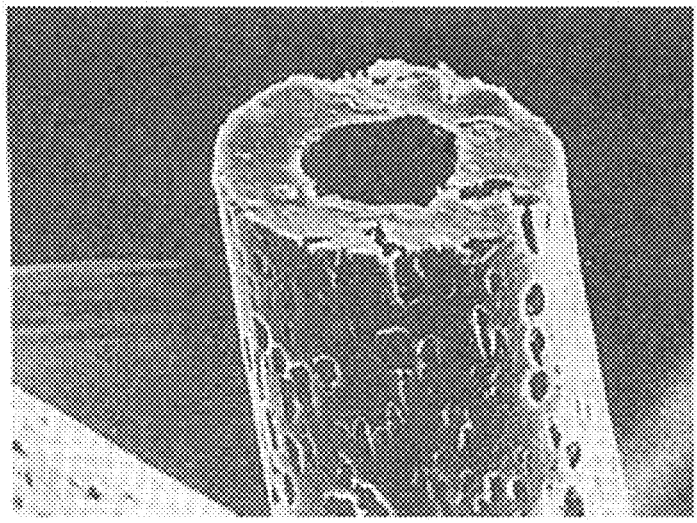
Fig 14a
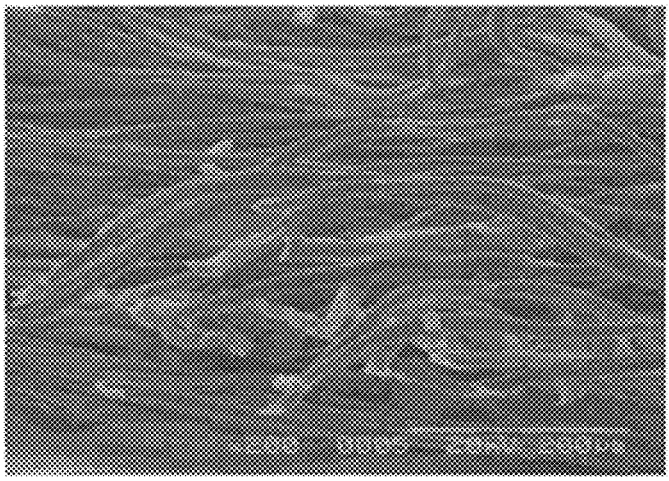
Fig 14b

METHOD FOR HEAT TRANSFER AND DEVICE THEREFOR

CROSS-REFERENCE TO RELATED APPLICATIONS

This is a U.S. national stage application of co-pending International Patent Application No. PCT/KR2007/003622, filed 27 Jul. 2007, which claims priority to Singapore Patent Application No. 200607076-7, filed 11 Oct. 2006, each of which is hereby incorporated herein.

TECHNICAL FIELD

A heat transfer device for transferring heat from a heat source to a heat-dissipating region is disclosed. The heat transfer device is particularly useful in thermal management of electronic components including micro-processors, liquid crystal displays (LCD), micro-electro-mechanical systems (MEMS), illuminating or radiating and like devices where the operation of such components produces excess heat that needs to be transferred away, or as a heating element for rapid and controlled heater.

BACKGROUND OF THE INVENTION

Many devices, due to their operation and throughput, produce heat which accumulates and adversely affect their continuous performance unless conducted away and dissipated. This is particular true for semiconductor devices such as processor devices (where the ever-increasing VLSI and processing speed and amount of data bits processed), liquid crystal displays(LCD), illuminating devices such as light-emitting diodes (LED), etc. where various heat transfer devices are being employed for thermal management.

One of the significant advances made is in respect of heat pipes which may be employed in a flexible structure comprising multiple laminates such as disclosed in U.S. Pat. No. 6,446,706 (Thermal Corp.) as shown in FIGS. 1*a* and 1*b* (Prior art). The flexible heat pipe includes a sealed outer casing (26) comprising a polypropylene layer (28), a first metal foil layer (32) attached to the polypropylene layer (28) by a first adhesive layer (30), a second metal foil layer (12) attached to the first metal foil layer 32 by a second adhesive layer 34, and a wick layer 24 which is formed using a flexible and porous material.

The heat pipe further includes a separation layer 18 which supports the wick layer 24 such that the wick layer 24 stays in close contact with the outer casing 26 and allows vapour to flow in many directions in the casing. The separation layer 18 is realized as a mesh screen made of polypropylene. The wick layer 24 is made of a copper felt material. The copper felt comprises micro-fibres, each having a diameter of 20 micro inches and a length of 0.2 inches, and copper powder filled in the wick structure in an amount of 20 to 60% of the total volume of the wick structure.

Whilst the flexibility of the laminated layers allows it to be affixed over and conforms to a device to be cooled, contact surfaces between the various laminate layers and the flexible heat pipe may be affected by the flexible material and configuration, thus affecting effective heat conduction.

FIG. 2 (Prior Art) illustrates a plate-type heat transfer device according to Korean Patent Laid-Open Publication Number 10-2004-18107. The heat transfer device comprises an upper plate 200, and a lower plate 100 disposed under the upper plate 200, having a gap between the upper plate 200 and the lower plate 100, in which the lower surface of the lower plate 100 corresponds to an evaporation part P1 and is in contact with a heat source. The heat transfer device further comprises wick plates 120 disposed so as to be in close contact with the upper surface of the lower plate 100 due to the surface tension of liquid coolant, and a spacer plate 110 for maintaining the distance between the lower plate 100 and the wick plate 120.

The liquid coolant circulates between the evaporation part P1 and a condensation part P2. That is, the liquid phase coolant continuously flows to the evaporation part P1 by means of capillary force generated between it and the lower plate, enters a vapour phase at the evaporation part P1, flows in a vapour phase toward the condensation part P2, and condenses at the condensation part P2. The spacer plate 110 serves to maintain the distance between the lower plate 100 and the wick plate 120 by using the surface tension generated between of them.

FIG. 3 is an illustration of third prior art of a flat sheet type heat transfer device disclosed in Korean Unexamined Patent Application No. 10-2004-91617. The heat transfer device shown in FIG. 3 comprises an upper metal plate 300, a lower metal plate 350, a pressuring support structure 310, and a plurality of thin plates 320 and 322, the pressuring pressure tension structure 310 and the thin plates 320 and 322 being interposed between the upper plate 300 and the lower plate 350. Each of the thin plates has through patterns that are parallel to each other, formed by a micromachining process. The pressuring pressure tension structure 310 is made of a porous material such as a mesh screen having through holes dense enough so that vapour, generated by the vaporization of coolant, occurring because the heat source is in contact with the lower surface of the lower plate 350, can move in a vertical direction.

The pressuring pressure tension structure 310 presses at least a portion of the parallel patterns of the thin plates 320 and 322 when assembled. Due to the pressure from the pressuring support plate 310, the parallel patterns of the thin plates 320 and 322 are form close contact with the upper surface of the lower plate 350, so that micro gaps, smaller than those of the patterns in an initial state, are formed. The micro gaps form fine coolant passages that are of few micro meters which are difficult to realize by the processing method such as etching or machining.

There are several limitations associated with the first prior art(U.S. Pat. No. 6,446,706). Firstly it is difficult to make the heat pipe which has a complex inner structure. Since the wick layer 24 is made of copper felt it is very difficult to maintain regular and strong contact between the inner surfaces of the outer casing and the wick layer 24. As such, forming of micro paths in the wick layer 24 is irregular, causing non-uniform capillary force that drives the flow. This creates high flow resistance which causes weak capillary force. Accordingly, when the coolant actively evaporates around a heat source, the flow of the vapour phase coolant may be cut off. Moreover, heat conductivity varies from point to point. Thus, reproducibility of the heat transfer device is poor. Another limitation is the thinness of the copper felt. Due to difficulty in manufacturing thin copper felt the total thinness of the heat pipe is limited by the thickness of the copper felt.

The second prior art(Korean Patent Laid-Open Publication Number 10-2004-18107) has also limitations. Micro machining is needed to manufacture a thin and complex structure to be inserted between an upper plate and a lower plate, thus limiting mass production. Accordingly, the device's enclosure can be manufactured no thinner than several mm thick. The device's configuration is structured according to the liquid coolant flows in gaps formed between planar wicks provided in the wick plate 120, or gaps formed between the wick plate 120 and the lower plate. Since the device incorporates micro structures, such as bridges, for connecting protrusions formed on the lower plate and the upper plate or connecting planar wicks, in order to form uniform gaps and to be mounted in the device confined enclosure, it is difficult to precisely machine such micro structures, as the micro structures are so complex and are several millimeters thick. Also, non-uniform gaps can result in drying out of the liquid phase coolant at the evaporation part, thereby causing fatal failure of the heat transfer device. In particular, mass production of such micro structures is more difficult since the structure is so much complex and machining errors can occur.

The third prior art(Korean Unexamined Patent Application No. 10-2004-91617) has following limitations. As shown in FIG. 4*a* and FIG. 4*b*, the thin metal plate or mesh is not wettable or liquid-absorbing because of the nature of the material and its design. This can create repelling of coolant that can cause dry out phenomena to occur. Furthermore, maintaining fine passages are very difficult due to manufacturing difficulties, increasing the cost of manufacturing. Reducing the thickness of the metal plate or mesh is critical in reducing the thickness of the device and the electronic device this is applied, but this process is difficult and incurs extra cost.

It would therefore be ideal to have a heat transfer device that overcomes the above limitations and disadvantages, towards which it is now proposed, as a general embodiment, a heat transfer device comprising at least an aggregate of fibres or sheet of fibres with internal passages and holes capable of capillary transport of liquids from a heat source region to heat dissipation region and vice versa; a supply of coolant fluid in sufficient amount absorbed or adsorbed by said fibres or sheet of fibres with internal passages and holes capable of capillary transport of liquids; pressure tension member (32) comprising a strong yet resilient structure placed within said confined space and exerting pressure on said aggregate of fibres or sheet of fibres with internal passages and holes capable of capillary transport of liquids against said heat source region (30) and/or heat dissipation region, wherein a plurality of undulations are provided on said pressure tension member; and a casing enclosing hermetically the aforesaid in a confined space.

SUMMARY OF THE INVENTION

In a first aspect of the invention, the undulations are provided at at least one of the heat source and heat dissipation regions. Alternatively, the undulations are provided in between the heat source and heat dissipation regions. The aforesaid undulations are preferably provided to accentuate the exerted pressure.

In a specific embodiment of our invention, the undulations are provided as laterally extending protuberances. Preferably, the laterally extending protuberance is in H- and like-shaped protuberance.

In another specific embodiment, the undulations may be preferably provided as protrusions extending in a direction perpendicular to inner surface of at least one of the enclosing members in which protrusions are provided in substantially hook-like shape, polygonal shape; including cylindrical, formed by machining, casting, press-moulding or like processes or combination thereof. The protrusions height are in less than 5 mm and are spaced equidistant in a range of about 0.2 to about 20 mm with a ratio of distance is at least 7:3 between protrusions to protrusion diameter.

In the second aspect of the invention, the pressure tension member is fabricated from metals, polymers, ceramics, silicon, organic or inorganic, stable, does not emit any form of gas or vapour at operation temperature ranges, does not peal off and non-reactive with the coolant, and it is configured to maintain internal space. The internal space outlined by the pressure tension member may preferably form connected pathways forming 3-dimensional space for vapour conduction.

A specific embodiment of the pressure tension member is to provide for an aggregate of fibres or sheet of fibres with internal passages and holes capable of capillary transport of liquids woven onto the pressure tension member or at least part thereof so that it is pressed against the fibres or sheet of fibres with internal passages and holes capable of capillary transport of liquids interwoven into a structural layer. Preferably, the pressure tension member is configured such that its structure occupies minimal volume of not more than 30% so as to maximise vaporisation space of at least 70% within the confined space.

Yet another aspect of the invention concerns the coolant which is a fluid having liquid-gas phase change of between −40° C. to 200° C. depending on to pressure exerted by at least one of the undulations of the pressure tension member. It may also be preferred to undergo phase change as it is conducted via capillary action from a heat source region to heat dissipation region and vice versa through the fibres or sheet of fibres with internal passages and holes capable of capillary transport of liquids and/or 3-dimensional space formed by the connected pathways outlined by the pressure tension member.

Still another aspect of the invention concerns the fibres or sheet of fibres with internal passages and holes capable of capillary transport of liquids which are preferably fabricated from non-metallic, synthetic, inorganic and organic materials which are stable and non-reactive with other components of the device such as carbon nano-tube, with its average ratio of diameter to length of a strand of a fibre is less than 0.05 and preferred to absorbent up to 90% of its volume.

A preferred embodiment of the fibres or sheet of fibres with internal passages and holes capable of capillary transport of liquids comprises tubular structures having at least one hollow channel tubular passage in the order of micro- or nanometer for intra-fibre capillary flow of coolant with diameter less than 1.0 mm or at least 10% of the fibre volume and fibre wall thickness less than 1.0 mm, with cross-sectional area of less than 0.79 $mm^2$. The preferred aspect ratio is in the range of about 0.01 to 2.0, and the fibres have diameters in the range of about 50 μm to 5.0 mm.

According to the following embodiment, the fibres are laid to converge towards the heat source region and diverge out to the heat dissipation region wherein the fibres are interwoven to form a structural shape with each fibre strand spaced at less than 500 μm.

The casing, being yet another aspect of the invention, may preferably comprises an upper enclosing member, lower enclosing member, in which complementarily closes upon each other to enclose a confined space thereinbetween in a fluid-proof manner; and a casing comprises a single member having an upper enclosing part and a lower enclosing part hingedly connected to each other and complementarily closes upon each other to enclose a confined space thereinbetween in a fluid-proof manner. It is preferably fabricated from metals, non-porous polymers, ceramics, crystals, inorganic and organic in which has good thermal conduction, where the internal surface does not in any form react with the internal materials such as the coolant and or the pressure tension structure, while the casing's inner surface area is increased by providing a plurality of fine channels formed by wet etching, dry etching, machining, pressing or casting or combinations thereof, and is resilient to increased internal vapour pressure.

The casing thus defines the device as being not more than 10.0 mm, the casing wall is not more than 5.0 mm thick and the confined space therewithin is less than 5.0 mm. Preferably, fibres are in contact with an inner surface of a casing member for phase transition of the coolant and the fibres are interposed between the pressure tension structure and inner surface of a casing member. The fibres are positioned at above and below surfaces of the pressure tension member at pressure-accentuated contact with at least one of the heat source region and heat dissipation region.

Our invention also discloses a method for transferring heat from a heat source region to a heat dissipation region the device is also included; which comprises steps of providing a plurality of liquid absorbing and holding means capable of capillary convection of coolant fluid, wherein said convection means are aggregated in a form contacting a heat source region at one end and a heat dissipation region at another end; supplying coolant fluid in sufficient amount, and absorbed and/or adsorbed by said fibres or sheet of fibres with internal passages and holes capable of capillary transport of liquids conduit means; imparting pressure on said fibres or sheet of fibres with internal passages and holes capable of capillary transport of liquids conduit means with pressure tensioning means, including providing undulating means on said pressure tensioning means; and carrying out aforesaid means and steps in a hermetically confined space.

This method is preferably implemented in a heat transfer device, heat-generating device, including semiconductor device, in thermal contact with a heat transfer device, chipset, circuit board or electronic component having a heat transfer device and/or appliance or machine.

BRIEF DESCRIPTION OF THE DRAWINGS

The drawings listed below, with the accompanying detailed description that follows, may provide better and further understanding of our invention as non-limiting and exemplary illustration of specific or preferred embodiments in which:

FIG. 5 comprising FIG. 5*a* and FIG. 5*b* respectively show the state of wettability of the non-metallic fibre sheet according to the present invention before and after lapse of one second;

FIG. 6 comprising

FIG. 7 comprising FIG. 7*a* and FIG. 7*b* show cross sectional views of the first embodiment in FIG. 6*a;*

FIG. 8*a* and FIG. 8*b* show respective unassembled views of the third and fourth embodiments of the present invention;

FIG. 9 comprising FIGS. 9*a*, 9*b*, 9*c* and 9*d*, wherein FIGS. 9*a* and 9*b* show cross sectional views of the third embodiment in FIG. 8*a*, and wherein FIGS. 9*c* and 9*d* show alternative embodiments of the protrusions;

FIG. 13 comprising FIG. 13*a* and FIG. 13*b*, illustrate end view of cross sections of two embodiments of the fibres or sheet of fibres with internal passages and holes capable of capillary transport of liquids used in our invention, respectively showing duo tubular passage in a schematic drawing and quad tubular passages in a scanning electron microscope photograph;

FIG. 14 comprising FIG. 14*a* and FIG. 14*b*, depict scanning electron microscope photographs of a fibre strand having a single tubular passage and an aggregate of fibres respectively.

DETAILED DESCRIPTION OF THE INVENTION

Figure 1A:
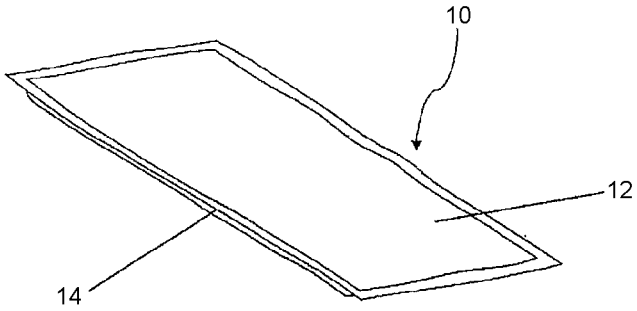
FIG. 1 (Prior art) comprising FIG. 1*a* and FIG. 1*b* respectively illustrate a perspective view and schematic cross-sectional view of U.S. Pat. No. 6,446,706 wherein a heat pipe configuration disposed in flexible laminate layers.
Figure 1B:
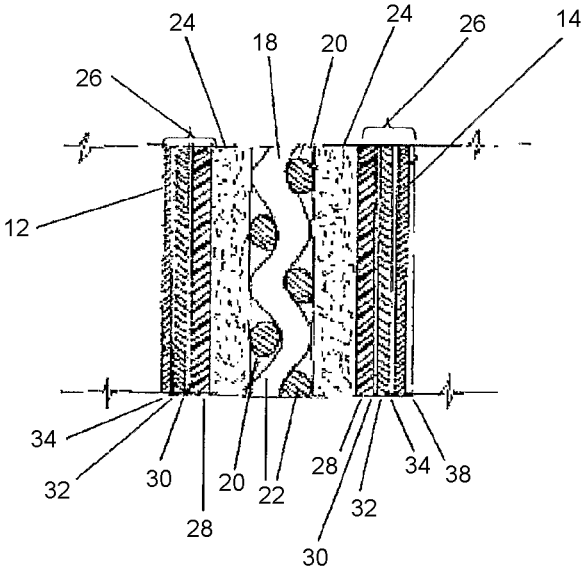
Figure 2:
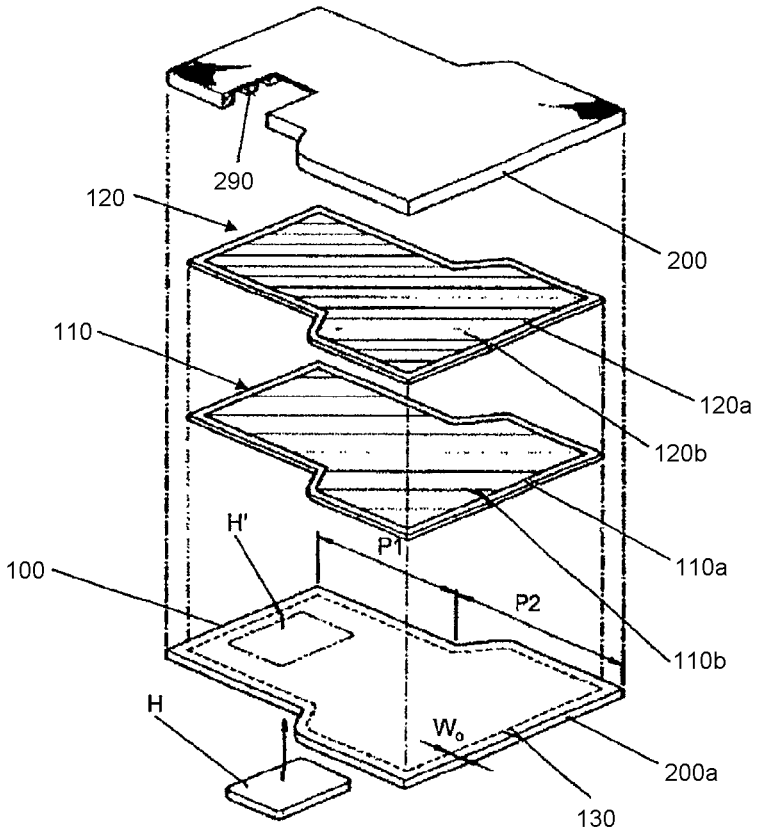
FIG. 2 (Prior art) shows a disassembled view of a plate or flat-type heat transfer device according to KR-10-2004-0018107 (Unexamined Publication)
Figure 3:
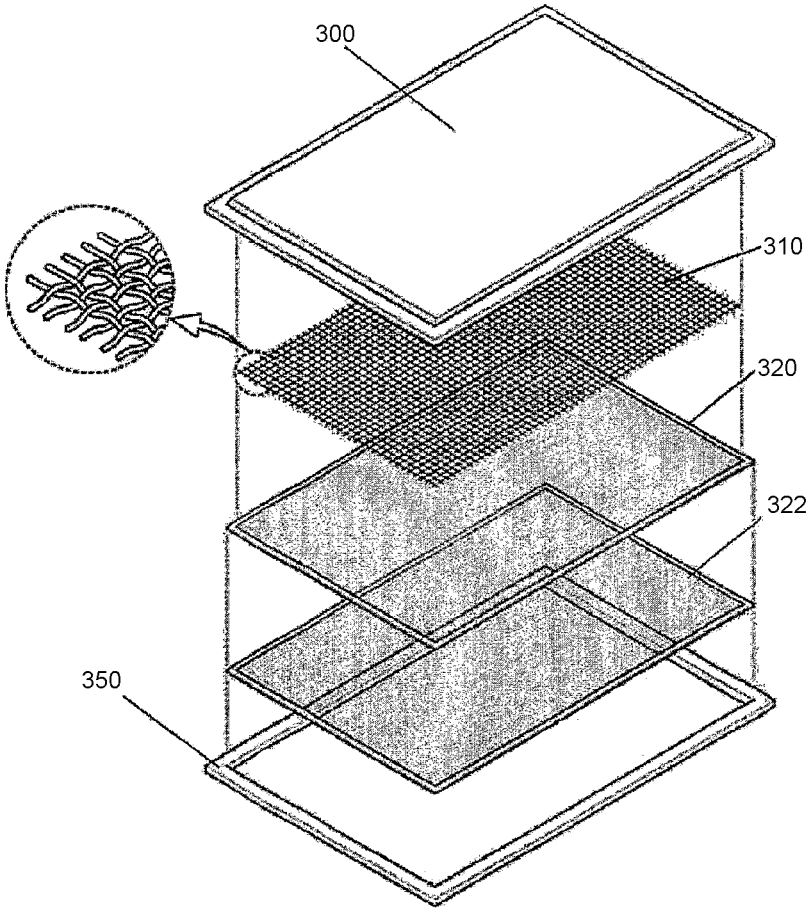
FIG. 3 (Prior art) illustrates a dissembled view of another plate or flat-type heat transfer device according to KR-10-2004-91617 (Laid-open Application)
Figure 4A:
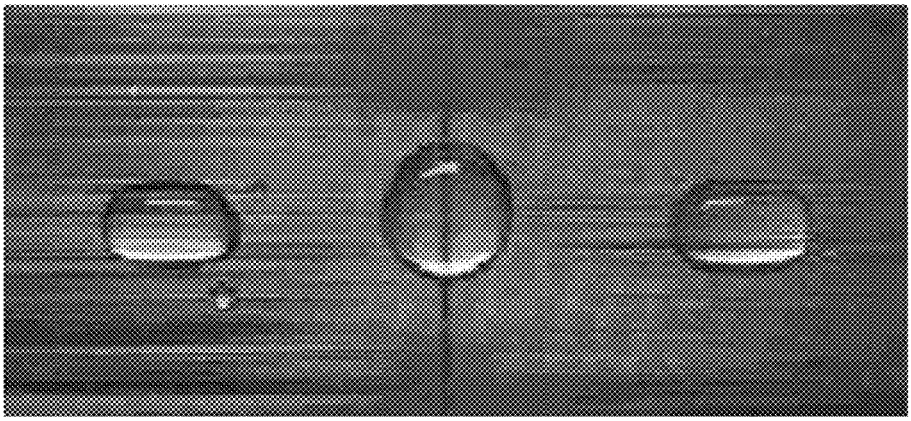
FIG. 4 (Prior art) comprising FIG. 4*a* and FIG. 4*b* respectively show comparative photographs of water adsorption and absorption characteristics between layer 320 and layer 322 of the prior art device in FIG. 3.
Figure 4B:
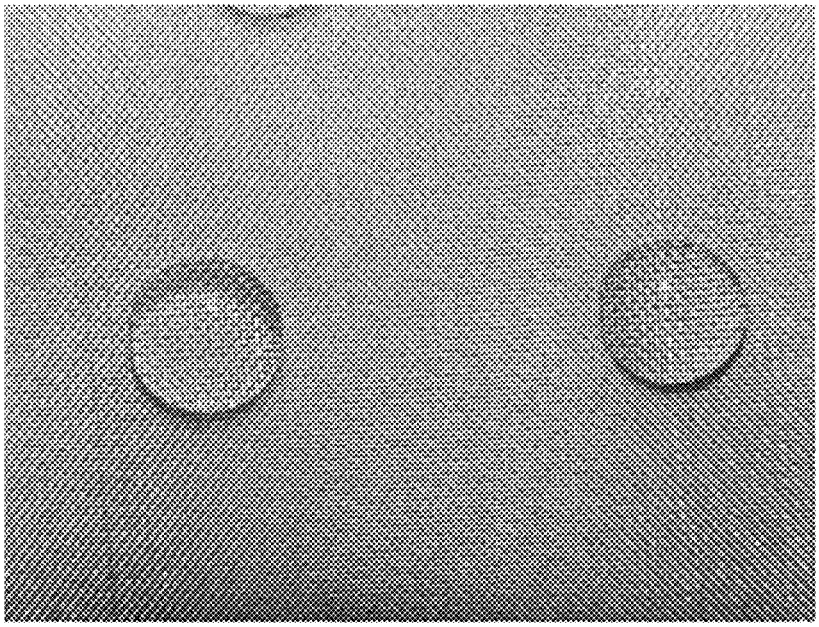

The effectiveness of the wettable surface material used in our device may be demonstrated by showing in FIG. 5*a* the dry non-metallic fibre sheet and the wettability state of the fibre sheet having been contacted with liquid after the lapse of about one second as shown in FIG. 5*b*.

FIGS. 6*a*, 6*b*, 7*a* and 7*b* shall now be referred collectively. The typical general embodiment of the device according to our invention should comprise of the following 3 parts or components contained in a casing (50) which substantially defines the external dimensions of the device. The casing encloses hermetically the parts or components in a confined space therein.

The first part or component is an aggregate of fibres or sheet of fibres (60) with internal passages and holes capable of capillary transport of liquids. By "aggregate" we mean to include any suitable structure, form, shape or pattern of the fibres which may be aggregated, woven, spun or like physical treatment.

The fibres have properties for capillary convection of fluid, including coolant fluid. This capillary property of the fibre would be necessary for the convection of coolant fluid from a heat source region to a heat dissipation region and vice versa. It should be noted that the heat source or dissipation regions are typically opposing parts or ends of the device or casing, such as top (51) and bottom (52) surfaces of the casing (50), or a proximal end (54) and distal end (56) of the casing (50) so that a thermal gradient may exist between the heat source and the heat dissipation region.

The second component of our device is a supply of coolant fluid in sufficient amount which is absorbed or adsorbed by the fibres or sheet of fibres with internal passages and holes capable of capillary transport of liquids. This is achieved by means of cavities formed by the passages and holes within the fibres or sheet of fibres.

The third component of our device is a pressure tension member (70) which is basically a strong yet resilient piece of structure. It is configured to maintain internal space of the casing to support it from collapsing or imploding due to external pressure or force or due to decrease in internal pressure due to excessive coolant vapourisation, etc.

The pressure tension member (70) is placed within the confined space of the casing (50) and is placed to exert pressure on the aggregate of fibres or sheet of fibres (60) with internal passages and holes capable of capillary transport of liquids against said heat source region, for illustrative purposes is indicated as the proximal end of the casing (54) and/or heat dissipation region which is illustratively indicated as the distal end of the casing (56).

A unique feature of our pressure tension member (70) is that a plurality of undulations (80) is provided on the pressure tension member (70). The undulations (80) may preferably be provided at one or both of the heat source (54) and heat dissipation regions (56), bearing in mind that the regions may also be the opposing sides (51, 52) of the casing (50).

Figure 6A:
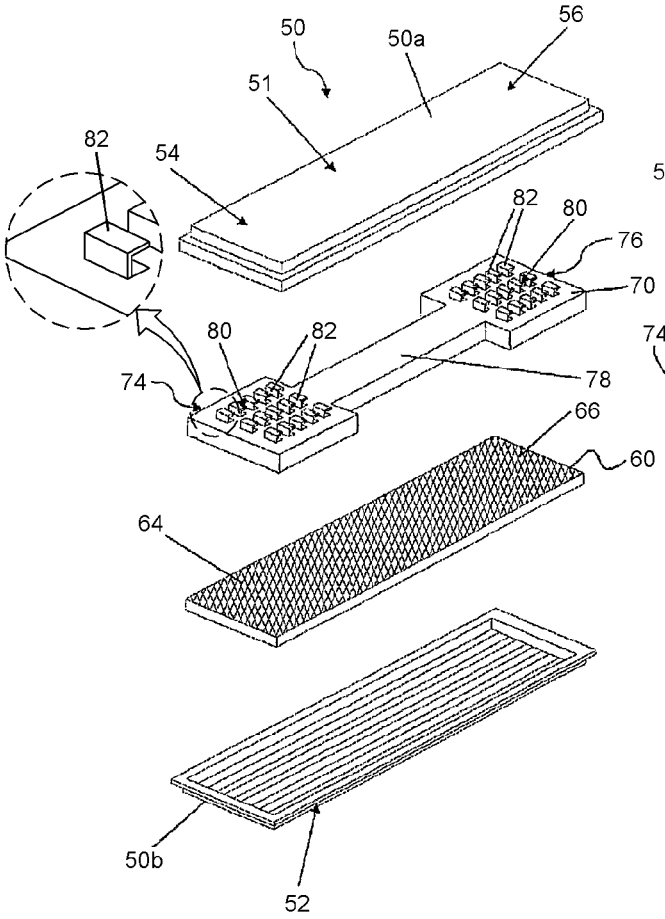
FIG. 6*a* and FIG. 6*b* show unassembled views of the first and second embodiments of our invention.
Figure 6B:
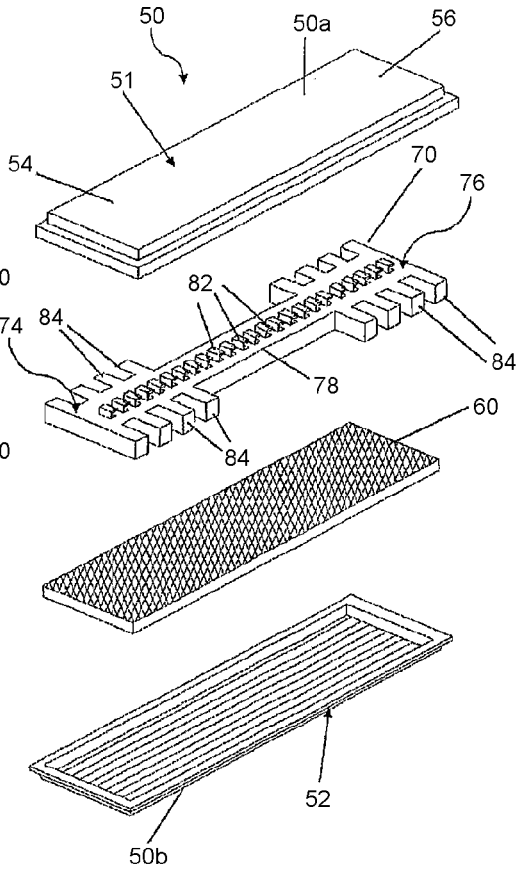
Figure 8:
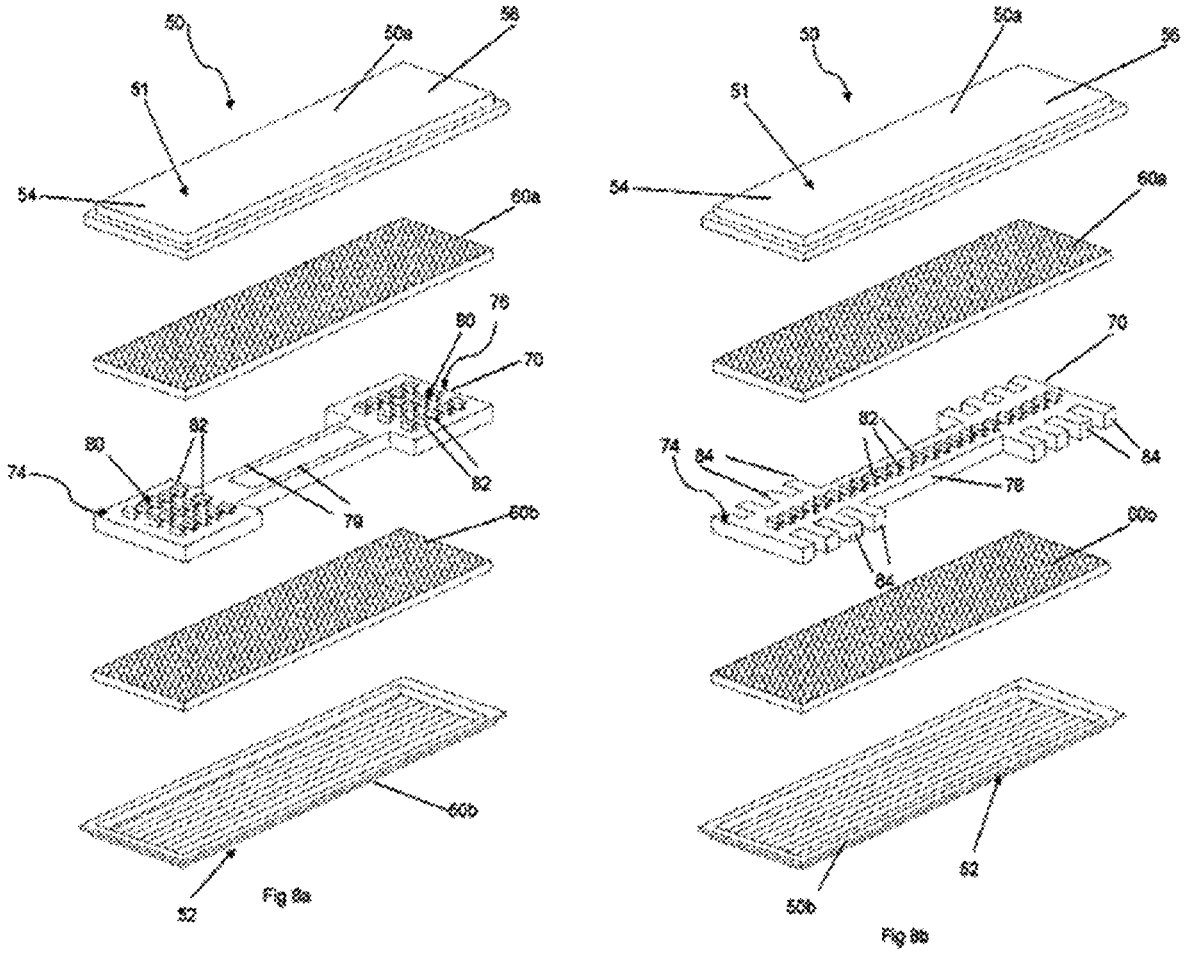
FIG. 8 comprising

The undulations may also be provided between the heat source region (74, 54) and the heat dissipating region (76, 56), such as that shown in FIG. 6*b* as a row of equidistal protrusions (82) linking the two regions.

While the undulations are provided to essentially accentuate the pressure exerted on the fibres or sheet of fibres with internal passages and holes capable of capillary transport of liquids according to the undulation pattern (in contrast with the prior art's uniform pressure exerted), 2 specific types of undulations are further described hereinafter although many other types may be derived from these two types.

The first type may described as laterally extending protuberances (84) which in FIG. 6*b* are shown as a plurality lateral rib extensions from the sides of the pressure tension member (70) in a symmetrical arrangement. Depending on the configuration of the heat transfer device the undulations distribution and the design of the pressure tension member (70) may be symmetrical or asymmetrical. The rib extensions may be seen as H-shaped protuberances (84) in the drawings. The rib extensions may also be provided to extend from the ends (not shown) of the pressure tension member (70) in addition to its longitudinal sides which is shown with the protuberances (84). With this H-shaped protuberances (84) provided atop or below an aggregate or layer of fibres or sheet of fibres with internal passages and holes capable of capillary transport of liquids, an undulating pressure may be created on the fibres following the undulations.

The second type of undulation may be described as protrusions (82) which are provided to extend from the top or bottom surface of the pressure tension member (70) in a perpendicular direction. For a casing having a rectangular block or plate shape, the protrusions (82) may be provided as extending perpendicularly from the surface of the pressure tension member. For a tubular, polygonal or cylindrical casing where the components may be laid to follow the casing's inner surface curvature, the protrusions may be provided to extend in a direction that is perpendicular to the inner surface of the casing.

A preferred embodiment of the protrusion (82) is a substantially hook-like shape as shown in the drawings. Other alternative shapes of the protrusion include polygonal shape, including cylindrical-like protrusions. All these protrusions may preferably be formed by machining, casting, press-moulding or like processes or combination thereof The hook-like protrusion, for example, may be fabricated by mould-pressing the appropriate part of the pressure tension member.

The protrusion's height is preferably less than 5 mm and each of the protrusion are preferably placed equidistantly with each other in a range of about 0.2 to about 20 mm. The ratio of distance between protrusions to protrusion diameter is preferably 7:3.

The pressure tension member (70) may preferably be fabricated from metals, polymers, ceramics, silicon, organic or inorganic materials, stable such that it does not emit any form of gas or vapour at given working temperature ranges or peal off and non-reactive with coolant.

While all the drawings herein show the fibres or sheet of fibres with internal passages and holes capable of capillary transport of liquids being aggregated, woven or spun into a separate layer (60) which conforms to the pressure tension member (70) or casing so that at least part of the pressure tension member (70) is pressed against the fibres or sheet of fibres with internal passages and holes capable of capillary transport of liquids which have been interwoven into a structural layer (60), as shown in various configurations FIGS. 6*a* 9*b*, 11 and 12, it is also possible for the fibres to be woven onto the pressure tension member with a certain thickness of the fibres overlaying the undulations, i.e. the protuberances (84) or protrusions (82), so that accentuated pressure may still be exerted on the fibres.

The pressure tension member (70) may preferably be configured such that the total volume of its structure occupies minimal volume occupied in the casing and thus maximise vaporization space within the confined space of the casing. Accordingly, to maximise the pressure tensioning portions of the member, the rib extensions layout may be maximised at regions where the pressure should be accentuated, such as the part of the pressure tension member (74) or casing (54) over the heat source region or the corresponding parts over the heat dissipation region (76, 56). The pressure tension member's structure in between the regions (78) may preferably be minimised accordingly as shown in FIGS. 6*a* and 6*b*. The space occupied by the pressure tension member should preferably be limited to not more than 30% of the total volume of the confined space so that more void or empty space is available for the coolant to evaporate. The void may be advantageously formed as connected 3 dimensional passage ways for vapour conduction, condensation or coolant liquid's evaporation according to the heat regions.

An ideal coolant for our device would be a fluid having liquid-gas phase transition that is in the range of −40° C. to 200° C. As with most fluids, the evaporation and condensation points would be subject to pressure. Our present device may provide 2 types of pressure, namely the accentuate pressure exerted by the undulations and, due to the 3-dimensional void passage way network created by the configuration of undulations of the pressure tension member, vapour pressure arising from the amount of coolant evaporated in the confined space. Depending on the amount of the coolant in gas phase, the temperature of the void and nature of the passage way, i.e. whether a dead end or a connected passage, a vapour pressure gradient may arise between the heat source region and heat dissipation region. This might assist in providing a suitable range of temperature and pressure for effecting the desired phase transitions of the coolant for an efficient thermal conduction.

A complete cycle of the coolant's transition within the device may be described as follows. The coolant fluid at the heat source region (64) will absorb heat until sufficient entropic energy to change phase and evaporates. The coolant vapour spreads out through the void of the confined space in the casing as defined by the pressure tension member's configuration of protrusions (82) and protuberances (84). The further the vapour is from the heat source region, the lower is the temperature according to the thermal gradient.

At the heat dissipation region, the temperature is the lowest where, with less entropy, the vapour tends to be denser resulting in increased vapour pressure, thus favouring the condensation of the coolant vapour back to liquid phase. The coolant liquid is adsorbed and absorbed by the fibres or sheet of fibres with internal passages and holes and channelled via capillary action through the fibres back to the heat source region.

To achieve such tasks, the fibres or sheet of fibres with internal passages and holes capable of capillary transport of liquids are preferably fabricated from non-metallic, synthetic, inorganic and organic materials which are stable, does not emit any form of gas or vapour and peal off at given operating temperature ranges and non-reactive with the other components of the device such as the casing's inner surface and the pressure tension member. A particularly preferred material is carbon nano-tubes. With such materials, the tubular structure of the fibres may be industrially produced with one or more hollow tubular passage therein in the order of micro- or nano-meter for effective intra-fibre capillary flow of the coolant in liquid phase.

On the physical dimensions of the fibres or sheet of fibres with internal passages and holes capable of capillary transport of liquids, the average ratio of diameter to length of each strand of fibre is preferable less than 0.05. The ideal fibres or sheet of fibres with internal passages and holes would be one that can absorb or contain up to 90% of its volume. A preferred tubular passage diameter is less than 1.0 mm with a cross-sectional area of tess than 0.79 $mm^2$. The tubular passage should ideally occupy at least 10% of the fibre volume and the fibre wall thickness should be less than 1.0 mm. Overall, the fibres or sheet of fibres with internal passages and holes capable of capillary transport of liquids ideal diameters are in the range of about 50 μm to 5.0 mm.

The depth of the channels must be less than 500 micrometers and the cross sectional area must be less than 2.5 $mm^2$ with the aspect ratio being less than 2.0 and greater than 0.01.

The fibres or sheet of fibres with internal passages and holes capable of capillary transport of liquids may be aggregated in any suitable way to form a structure that may range in density from loose to packed form. The aggregation may be achieved by a suitable treatment such as weaving, spinning, laying, aligning or simply grown and the like so that the strands of fibres are laid longitudinally from a heat source region to a heat dissipation region. For example, the fibres may be interwoven to form a structural shape with each fibre strand spaced at less than 500 μm. With such close proximity of the strands together, in addition to the intra-strand capillary action through the hollow tubular passage inside each fibre when the coolant fluid is absorbed or contained thereinto, the adsorption and containment of the coolant fluid on the external fibre strand surface may also be promote inter fibre or inter-strand capillary action of closely placed adjacent fibres as a result of the adsorption or affinity of the fibres' surfaces for the coolant fluid.

It is preferred that the fibres are laid in a manner that converge towards the heat source region and diverge out to the heat dissipation region.

When our heat transfer device, which specific embodiment shown unassembled in FIG. 6*a* includes a single layer of fibres or sheet of fibres (60) with internal passages and holes capable of capillary transport of liquids, is assembled as shown in cross sectional view in FIG. 7*a* and FIG. 7*b*, the pressure tension member (70) is placed atop the layer of fibres or sheet of fibres (60) with internal passages and holes capable of capillary transport of liquids with the lower surface of the protrusions (82) pressed against the fibres (60). The protrusions (82) are provided in addition to the lateral ribs or protuberances (84). In particular, the protrusions are provided atop the lateral plane of the protuberances (84). The protrusions (82) therefore form the pressure points against the layer of fibres or sheet of fibres (60) with internal passages and holes capable of capillary transport of liquids.

The protrusions (82) may also be provided to project out from the bottom surface of the pressure tension member (70) as shown in cross sectional view in FIGS. 7*a* and 7*b*. With the sole layer of fibres or sheet of fibres (60) with internal passages and holes capable of capillary transport of liquids being placed at below the pressure tension member (70), the lower protrusions (82) thus forms the pressure points against the fibres or sheet of fibres (60) with internal passages and holes capable of capillary transport of liquids.

The distribution of the protrusions (82) may also be provided in the most advantageous manner to heat conduction. In FIG. 6*a*, the protrusions (82) are shown provided in a concentrated manner in two regions, namely the heat source region (74) and the heat dissipation region (74). In this pattern of distribution, the fibres or sheet of fibres with internal passages and are pressed at the heat source region to maximise surface area contact and thus maximise conduction of heat from the heat source to the fibres to be conducted away. At the heat dissipation region, the fibres or sheet of fibres with internal passages and holes pressed against the protrusions (82) will maximise the surface area contact and maximise the conduction of heat from the fibres to the heat dissipation region.

Another example of protrusions (82) distribution is shown in FIG. 6*b* wherein the protrusions (82) are provided in a line linking the heat source region (74) and the heat dissipation region (76) so that the fibres or sheet of fibres with internal passages and in between or that linking the two regions are pressed against the pressure points of the pressure tension member for more surface area contact and thus more efficient conduction of heat between the two regions.

In another embodiment of our device, it is possible to provide multiple layers of fibres or sheet of fibres (60*a*, 60*b*) with internal passages and holes capable of capillary transport of liquids, i.e. one on each of the top and bottom surfaces of the pressure tension member (70) as shown collectively in FIGS. 8*a*, 8*b*, 9*a* and 9*b*. The protrusions (82) provided above and below the pressure tension member (70) to each press against the upper (60*a*) and lower (60*b*). It is anticipated that such configuration would be advantageous for a heat transfer device which is configured with the heat source and heat dissipation regions in the opposing sides of the casing (50*a*, 50*b*).

FIGS. 9*c* and 9*d* show different ways of making a pressure tension structure. The pressure tension structure is made from the same material as fibres or sheet of fibres (60) with internal passages and holes capable of capillary transport of liquids used for transportation of liquids by either adding separate sheet of fibres atop one another or conforming by pressing fibres or sheet of fibres to the configuration or machining out from a thick sheet of fibres to configuration or combination of it.

Figure 10:
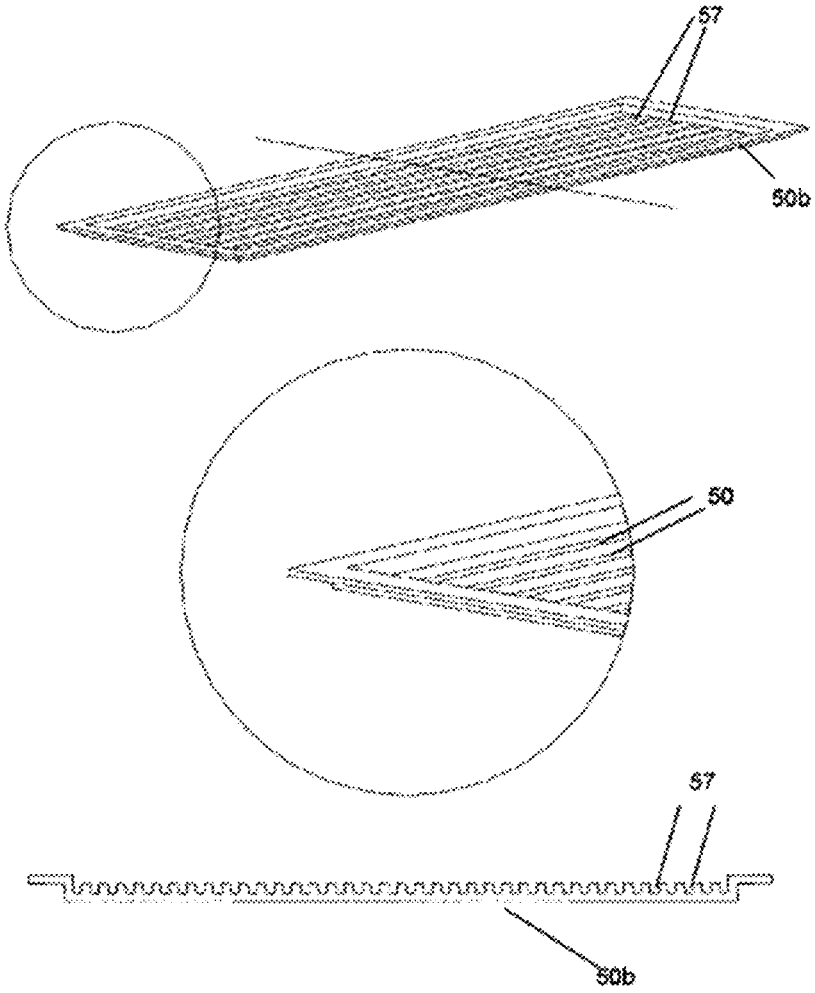
FIG. 10 illustrates perspective, detail and cross sectional view of a casing member formed with fine channels on its inner surface.

With reference to the inner surfaces of the casing, it is preferable that the lower casing member's inner is provided with longitudinal ribs (55) as shown in FIGS. 6*a*, 6*b*, 8*a*, 8*b*. Alternatively, a plurality of fine channels (57) is provided as shown in FIG. 10. These fine channels (57) may be formed by wet etching, dry etching, machining, pressing or casting or combinations thereof.

The longitudinal ribs (55) provide the pressure points in the same way as the pressure tension member's undulations while at the same time increases surface for heat conduction.

The fine channels (57) will also provide an increased surface area for heat conduction while at the same time provide for increased capillary action.

Figure 11:
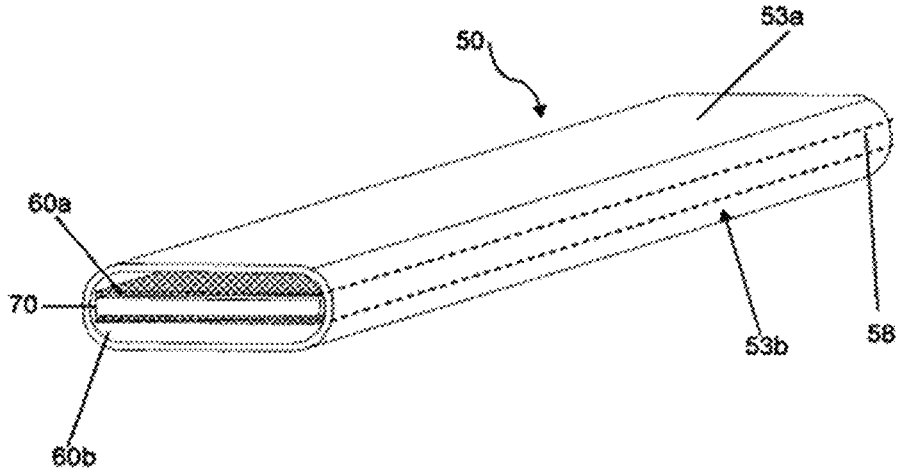
FIG. 11 shows a perspective view with an open end of a tubular shape embodiment of the device according to the invention.
Figure 12:
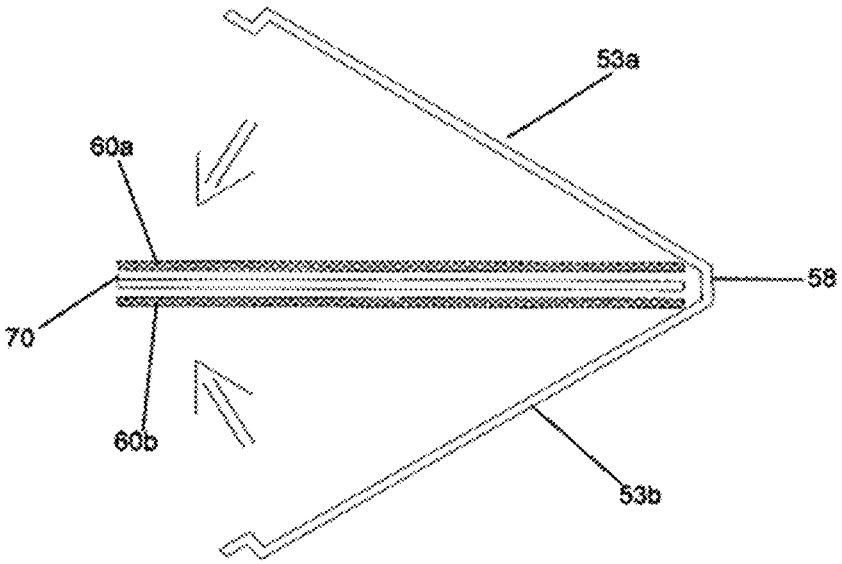
FIG. 12 shows a cross sectional view of the tubular shape embodiment of FIG. 11 in an opened clam-shell configuration.

While it is generally considered that the casing (50) of our heat transfer device would comprise an upper enclosing member (50*a*) and a lower enclosing member (50*b*) which complementarily closes upon each other to enclose a confined space therein between in a fluid-proof manner or hermetically, it is also possible to provide for a casing which comprises of a single member having an upper enclosing part (53*a*) and a lower enclosing part (53*b*) hingedly connected to each other by a hinge portion (58) running lengthwise of the casing. The upper enclosing part (53*a*) and lower enclosing part (53*b*) and complementarily closes upon each other to enclose a confined space therein between in a fluid-proof manner as shown in FIG. 11 in a closed tubular shape, and FIG. 12 showing the tubular casing opened in clam-shell and hinge configuration.

The casing may be fabricated from metals, non-porous polymers, ceramics, crystalline, inorganic or organic materials having good thermal conduction, or composites therefrom. Preferably, the chosen materials results in a casing that is resilient to increase internal vapour pressure. The device's dimension is defined principally by the dimensions of the casing which for practical reasons should not be more than 10.0 mm. The casing wall should not be more than 5.0 mm thick whereas the confined space enclosed in the casing is less than 5.0 mm.

The fibres' or sheet of fibres' with internal passages and holes capable of capillary transport of liquids physical characteristics may be shown collectively in FIGS. 13*a*, 13*b*, 14*a* and 14*b*. FIG. 13*a* shows a scanning electron microscope photograph of an aggregate of fibres or sheet of fibres with internal passages and holes while FIG. 13*b* shows a SEM photograph of an open end of a single strand of the fibres. The fibre is shown with a single hollow tubular passage. Fibres having multiple tubular passages are shown in FIGS. 14*a* and 14*b* wherein two and four tubular passages (62) are illustrated in form of a schematic drawing and a SEM photograph respectively.

Briefly, our heat transfer device works by implementing a method for transferring heat from a heat source region to a heat dissipation region on the device in the following steps, which are:

providing a plurality of fibres or sheet of fibres with internal passages and holes capable of capillary transport of liquids means capable of capillary convection of coolant fluid, wherein said convection means are aggregated in a form contacting a heat source region at one end and a heat dissipation region at another end;

supplying coolant fluid in sufficient amount, and absorbed and/or adsorbed and/or contained by said fibres or sheet of fibres with internal passages and holes conduit means;

imparting pressure on said fibres or sheet of fibres with internal passages and conduit means with pressure tensioning means, including providing undulating means on said pressure tensioning means; and carrying out aforesaid means and steps in a hermetically confined space.

The aforesaid configuration of the device and method may be implemented in a device for heat transfer to be in thermal contact with another device or article, particularly for semiconductor devices, chipset, circuit board or electronic components wherein excess heat produced has to be removed for optimal performance or where rapid and controlled heating is required.

Accordingly, it would be obvious to a skilled person that many of the above components may be adapted, modified or replaced with an equivalent component or part without departing from the aforesaid method or the principal features of our heat transfer device. These substitutes, alternatives or modifications are to be considered as falling within the scope and letter of the following claims.

What is claimed is:

1. A heat transfer device comprising:

a casing, said casing having a top member and a bottom member, wherein the members complementarily close upon each other to hermetically enclose a confined space therebetween;

a plurality of fibers, said plurality of fibers being disposed within the confined space and being formed with internal passages and holes capable of capillary transport of liquids between a heat source region and a heat dissipation region;

a coolant fluid received by said plurality of fibers within the confined space;

a pressure tension member comprising a structure placed within the confined space to maintain the void of the confined space, such that the coolant fluid in a vapor phase thereof can spread out and exert pressure on said plurality of fibers, wherein a plurality of undulations are provided on said pressure tension member, said pressure tension member consisting of a first portion corresponding to the heat source region, a second portion corresponding to the heat dissipation region, and a longitudinally-extending central portion positioned therebetween and being coplanar with the first and second portions, wherein the first portion and the second portion are longitudinally opposed and separated from one another and the combination of the first and second portions and the longitudinally-extending central portion extends the same length in the longitudinal direction as the plurality of fibers and is not coextensive with the plurality of fibers, the first portion having a first lateral width associated therewith and the second portion having a second lateral width associated therewith, such that the first and second lateral widths are each greater than a lateral width of the longitudinally-extending central portion.

2. A heat transfer device according to claim 1 wherein the undulations are provided at at least one of the heat source and heat dissipation regions.

3. A heat transfer device according to claim 1 wherein the undulations are provided between the heat source region and the heat dissipation region.

4. A heat transfer device according to claim 1 wherein the undulations are laterally extending protuberances.

5. A heat transfer device according to claim 4 wherein the laterally extending protuberance is H-shaped.

6. A heat transfer device according to claim 1 wherein the undulations are protrusions extending in a direction perpendicular to inner surface of at least one of the enclosing members.

7. A heat transfer device according to claim 6 wherein the protrusions are provided in substantially hook-like shape.

8. A heat transfer device according to claim 1 wherein the casing comprises at least an upper enclosing member, and at least a lower enclosing member, and the casing complementarily closes upon each other to enclose a confined space thereinbetween in a fluid-proof manner.

9. A heat transfer device according to claim 1 wherein the casing comprises a single member having an upper enclosing part and a lower enclosing part hingedly connected to each other and complementarily closes upon each other to enclose a confined space thereinbetween in a fluid-proof manner.

10. A heat transfer device according to claim 1 wherein the aggregate of fibres or sheet of fibres with internal passages and holes capable of capillary transport of liquids are woven or fabricated integrally as the shape of a pressure tension member.

11. A heat transfer device consisting of:

a casing, said casing having a top member and a bottom member, wherein the members complementarily close upon each other to hermetically enclose a confined space therebetween;

a plurality of fibers, said plurality of fibers being disposed within the confined space and being formed with internal passages and holes capable of capillary transport of liquids between a heat source region and a heat dissipation region;

a coolant fluid received by said plurality of fibers within the confined space;

a pressure tension member comprising a structure placed within the confined space to maintain the void of the confined space, such that the coolant fluid in a vapor phase thereof can spread out and exert pressure on said plurality of fibers, wherein a plurality of undulations are provided on said pressure tension member, said pressure tension member consisting of a first portion corresponding to the heat source region, a second portion corresponding to the heat dissipation region, and a longitudinally-extending central portion positioned therebetween and being coplanar with the first and second portions, wherein the first portion and the second portion are longitudinally opposed and separated from one another and the combination of the first and second portions and the longitudinally-extending central portion extends the same length in the longitudinal direction as the plurality of fibers and is not coextensive with the plurality of fibers, the first portion having a first lateral width associated therewith and the second portion having a second lateral width associated therewith, such that the first and second lateral widths are each greater than a lateral width of the longitudinally-extending central portion.

* * * * *